United States Patent [19]

Bennett

[11] Patent Number: 4,879,154

[45] Date of Patent: Nov. 7, 1989

[54] REINFORCED UTILITY MAT ADAPTABLE AS MILITARY OVERHEAD FOXHOLE COVER AND FOOT SUSPENSION BRIDGE

[75] Inventor: Stephen H. Bennett, Alexandria, Va.

[73] Assignee: United States of America as represented by the Secretary of the Army, Washington, D.C.

[21] Appl. No.: 292,076

[22] Filed: Dec. 30, 1988

[51] Int. Cl.[4] ..... B32B 3/06

[52] U.S. Cl. ..... 428/81; 428/99

[58] Field of Search ..... 428/81, 99; 52/3–5

[56] References Cited

U.S. PATENT DOCUMENTS 2,455,237 11/1948 Davis ..... 52/3

*Primary Examiner*—Alexander S. Thomas

*Attorney, Agent, or Firm*—Milton W. Lee; Anthony T. Lane

[57] ABSTRACT

A portable mat assembly for combat soldiers suitable for battlefield emplacement preferably as an overhead cover assembly for supporting a load of loose and/or sandbagged soil over a foxhole battle position to provide occupants of the position protection against high velocity ballistic fragments and blast overpressure produced by near-miss indirect fire, but also adaptable for use as camouflage, as a foot bridge across a narrow ravine or ditch, or as revetment, or any other general utilitarian function, wherein the overhead cover assembly comprises a soil supporting member including a fabric membrane; a support net disposed beneath the fabric membrane, substantially fully co-extensive therewith and attached thereto, the support net including a plurality of longitudinally extending principal load carrying or reinforcing stringers, a plurality of transversely extending bracing elements or straps interconnected with the longitudinal straps or stringers; wherein deadman sleeve members provided on the fabric membrane adjacent opposite ends thereof whereby when the sleeve members are filled with logs or loose soil, an anchoring effect will be provided, loops are formed at opposite ends of the stringers for reception of stakes or the like to provide additional anchoring, and fold-up straps extend from opposite ends of some of the bracing elements or adjacent thereto whereby when a pair of fold-up straps are connected to each other above the cover assembly, cover assembly will be folded up along opposite sides to form a trough or pocket to minimize spillage of soil supported by cover.

10 Claims, 3 Drawing Sheets

REINFORCED UTILITY MAT ADAPTABLE AS MILITARY OVERHEAD FOXHOLE COVER AND FOOT SUSPENSION BRIDGE

GOVERNMENT INTEREST

The invention hereof may be used by and for the U.S. Government for governmental use without the payment of any royalties and is being assigned to the U.S. Government.

BACKGROUND OF THE INVENTION

This invention relates broadly to reinforced utility mats or the like which can be used variously as tarpaulins, tent-like shelter halves, windbreak sheeting, revetting, cargo slings, and other various uses. More specifically, the invention relates to two modified types of such utility mats which are particularly applicable to military use by combat engineers and field soldiers being particularly further useful primarily as overhead foxhole cover means and, alternatively, as suspension foot bridge means.

First considering the stated primary use for my utility mat, the improved mat herein is useful as a portable mat assembly for combat soldiers suitable for field emplacement preferably as an overhead cover for a foxhole to provide light infantry troops with protection from near-miss indirect fire under combat conditions, but also adaptable for use as camouflage, as a foot bridge across a narrow ravine or ditch, or as revetment, or any other general utilitarian function. In particular, the protection is provided for personnel fighting from within foxholes. It is conventional that light infantry troops fight on foot to take and hold objectives. In the course of such operations, the troops may be subjected to indirect fire from weapons using overpressure and high-velocity fragments which could inflict casualties upon them. Inasmuch as indirect fire is a primary cause of casualty against light infantry in both the offense and defense, countermeasures thereagainst are needed. Tests have shown that properly constructed overhead cover for defensive fighting positions can be the effective countermeasure to enhance the dismounted soldier's chances of surviving the threat of indirect fire. Methods presently available as overhead cover for individual fighting positions are considered inadequate and unsafe in the modern battlefield. Besides being very labor and material intensive, the resulting structures are frequently improperly designed and built as a result of lack of time, tools, and knowledge. Because of the rapid pace in the modern battlefield, overhead covers besides being effective, must also be capable of rapid installation, for example, within fifteen to thirty minutes. A lightweight, prefabricated apparatus fully equipped with all installation hardware would relieve unit leaders of the logistic and coordination task of providing the designs, tools, skills, and materials required to fabricate effective overhead cover. Hasty overhead cover is not intended to fully protect against direct-hits of indirect fire weapons rounds which in addition to blast and fragments, cause casualties by kinetic energy. A lightweight, overhead cover structure system, supporting 18"–36" of soil can provide protection against high-velocity ballistic fragments and blast overpressure produced by near-miss indirect fire.

Prior overhead protection apparatuses generally resembled a poncho with two sleeves at each end which, when filled with earth, acted as deadman anchors. The deadman components were then buried in shallow trenches parallel to the fighting position walls and the overhead cover was backfilled to a depth of 18". Sections of the overhead cover could be snapped together to cover along trenches. The overhead cover had a total weight of about two pounds and could cover a 36" wide excavated position. The overhead cover was designed to be carried as part of a soldier's combat load and was expendable. Fabric failure of the prior apparatuses occurred in tests at approximately 13 psi overpressure, with tearing along the fabric edge parallel to the foxhole sides. No pullout of the deadman was noted, if properly installed. However, improper installation resulted in collapse of the cover. Also, the overhead cover could not retain a uniform soil cover due to the tendency of soil to fall off the edge into the excavated fighting position.

While the preferred use of this invention is discussed above in conjunction with its use as an overhead cover for foxholes, it is amply clear that my mat assembly may equally well serve as camouflage to obscure battle positions to be placed and secured across a narrow ravine or ditch to support personnel movement thereacross. It is, moreover, also clear that the mat assembly may be put to use as revetment along battlefield surface for general purposes obtainable therefrom.

SUMMARY OF THE PRESENT INVENTION

With the foregoing background in mind, applicant has conceived and developed the invention disclosed herein to provide a new and improved overhead cover mat for foxholes which will provide overhead cover for two men in a standard two-man fighting position measuring not more than 36" in width, either elevated or at ground level.

It is another object of the present invention to provide an overhead cover for a foxhole which will support a dead load of 18" uniform depth of loose and/or sandbagged soil when spanning a 36" wide position.

It is a further object of the present invention to provide a new and improved overhead cover for foxholes which will support the dead load plus a live load of 15 lbs. psi acting for 2.5 milliseconds, the equivalent of a 155 mm artillery round exploding on the surface at a distance of about 15 feet.

It is yet another object of the present invention to provide a new and improved overhead cover for foxholes which will resist fungus and penetration by water.

Another object of the present invention is to provide a new and improved overhead cover for foxholes which when covered with 18–24 inches of dirt will provide V50 ballistic protection, i.e., provide generally 50% effective protection against 22 caliber fragment simulating projectiles at 1500 ft. per second.

Still another object of the present invention is to provide a new and improved overhead cover for foxholes which will resist penetration of blister and nerve agents.

Still another object of the present invention is to provide a new and improved overhead cover for foxholes which will permit transportation on a standard 40"×48" pallet.

An additional object of the present invention is to provide a new and improved overhead cover for foxholes which, with the necessary stakes and straps, will not exceed 35 lbs. in weight and thus will be readily portable at least 300 meters by a soldier in full combat gear.

A further object of the present invention is to provide a new and improved reinforced mat or cover which can be installed similarly but used alternatively as a foot suspension bridge for small gullies or trenches.

Yet another object of the present invention is to provide a new and improved mat assembly which may be placed and secured across a narrow ravine or ditch for use as a foot bridge.

Yet a further object of the present invention is to provide a new and improved mat assembly which is suitable as field emplacement to obscure battle positions or equipment camouflaged thereby.

It is, moreover, a further object of the present invention to provide a new and improved mat assembly which is suitable for use with sand, dirt, debris, or the like as emplacement on the ground, walls, or other battlefield surfaces as revetment therefor.

BRIEF DESCRIPTION OF THE DRAWINGS

Referring to the accompanying drawings, the reader will see that.

DETAILED DESCRIPTION OF THE INVENTION

Figure 1:
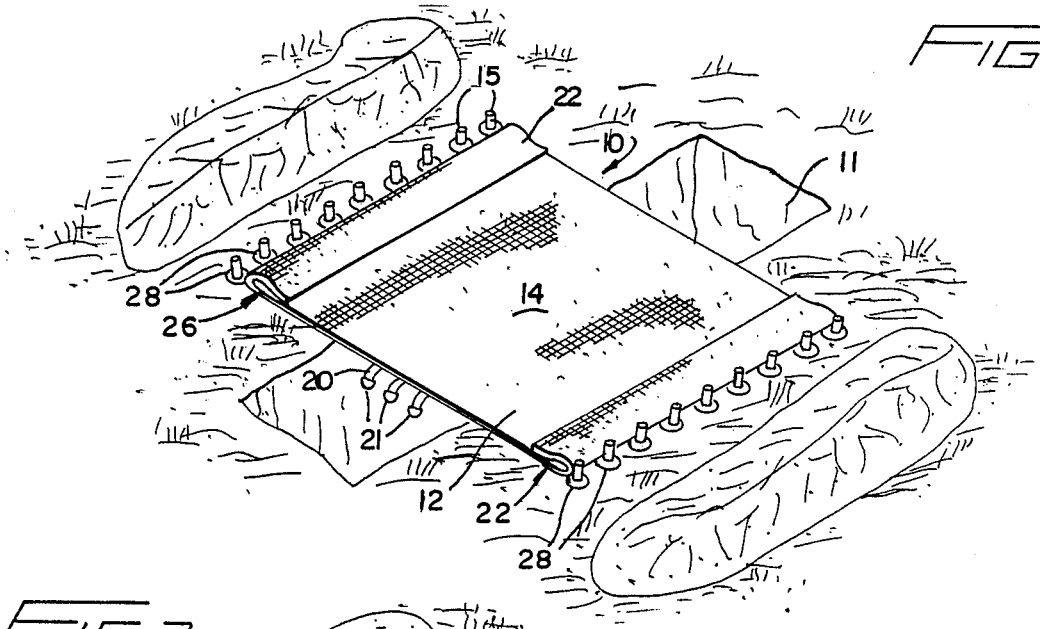
FIG. 1 is a schematic perspective representation of the soil supporting fabric of FIG. 5 placed in position over the support net in FIG. 2.
Figure 2:
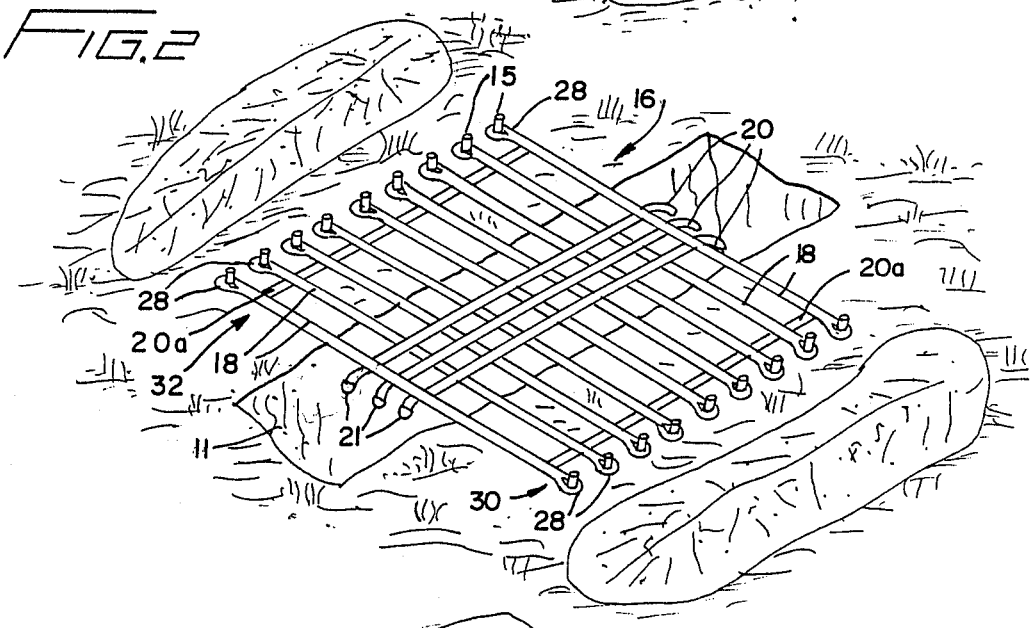
FIG. 2 is a schematic perspective representation of the support net of FIG. 4 secured in place across the top of a foxhole.
Figure 3:
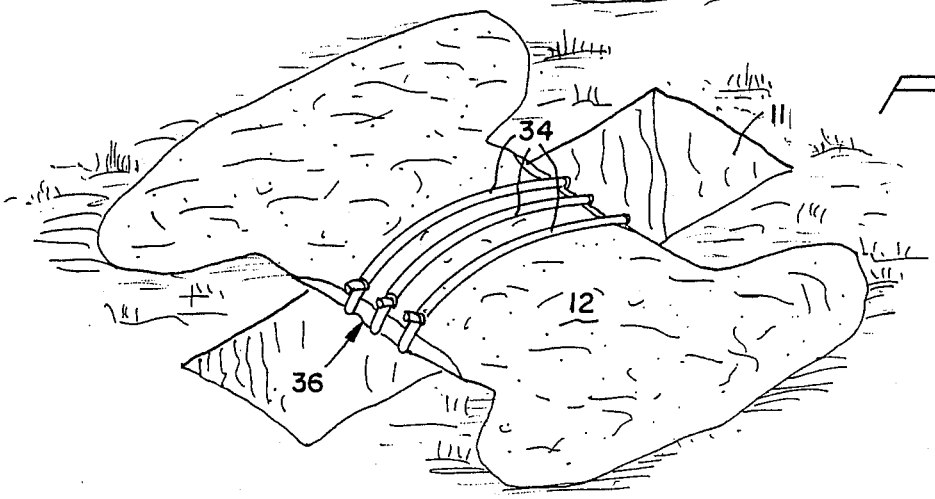
FIG. 3 is a perspective representation of the components illustrated in FIG. 1 with dirt and/or sand placed thereover and lateral edges of the assembly secured together to cradle the dirt thereon.
Figure 9:
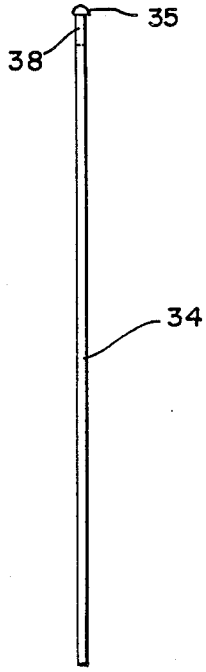
FIG. 9 represents a plan view of an exemplary fold-up strap for interconnecting lateral opposed edges of the support net or fabric to form a troughed or cradled support for the emplaced dirt thereon.

Referring in detail initially to FIGS. 1–3 of the drawings, the reader will see that the disclosed invention resides in an overhead cover assembly 10 represented schematically as being secured in place over a battlefield foxhole 11. The cover assembly 10 comprises two principal parts, namely, a soil supporting component 12, including a fabric membrane 14, and a support net 16. The two principal parts of cover assembly 10 may be made as separate components secured together in use or may be made as an integrally assembled unit. As represented in FIG. 2, the support net 16, made as a separate component, comprises a plurality of flexible longitudinally extending strap-like stringers 18 stretched tautly across the top of foxhole 11 in generally parallel relationship. Support net 16 is secured on opposite sides of foxhole 11 as clearly depicted in FIG. 2 by loops 28 at opposite ends 30, 32 of the stringers 18 through which loops stakes 15 are anchored. Support net 16 also includes a plurality of generally parallel spaced, transversely extending flexible strap-like bracing elements 20, two of which (FIGS. 2 and 4) extend adjacent opposite ends of stringers 18, and three of which extend generally adjacent the center of stringers 18, are interconnected to the stringers 18 and extend over the expanse of foxhole 11. Soil supporting component 12 is placed over support net 16 and is secured thereover with logs, dirt, soil, sand or the like preferably placed inside of sleeves 22 referred to a deadman sleeves formed on opposite ends of fabric membrane 14 as may be seen in FIG. 1. Thereafter, the assembly 10 is covered with dirt as illustrated in FIG. 3 to provide protection for troop occupants of foxhole 11. To help orient and secure the membrane 14 upon the support net 16, opposite end portions of the three medial bracing straps 20 are respectively inserted through apertures formed in the opposite lateral edges of the membrane 14, to be described hereinafter. Flexible fold-up straps 34 (FIGS. 9 and 3) connectable to said opposite ends of these medially disposed bracing elements 20 are adaptable to fold up opposite sides 36 of membrane 14 to cradle the emplaced dirt and thereby minimize spillage thereof.

Referring now in detail to the drawings, the reader will readily see in FIGS. 4–9 a preferred form of the disclosed invention embodied in an overhead cover assembly 10 for supporting a load of loose and/or sandbagged soil over a foxhole battle position to provide occupants of the position, such as foxhole 11, protection against high velocity ballistic fragments and blast overpressure produced by near-miss indirect fire. Overhead cover assembly 10 may thus be seen to comprise soil supporting component 12 including a fabric membrane 14 and a support net 16 disposed beneath fabric membrane 14, substantially fully co-extensive therewith and selectively attachable thereto. Support net 16 includes a plurality of parallel longitudinally extending principal load carrying reinforcing straps or stringers 18, and a plurality of bracing elements **20, 20*a* interconnected to and extending transversely of stringers 18. The deadman sleeve members 22 are provided on fabric membrane 14 adjacent opposite ends 24, 26 thereof. When sleeve members 22 are filled with logs or loose soil, an anchoring effect will be provided thereby. The loops 28 are formed at opposite ends 30, 32 of stringers 18 for reception of stakes or the like to provide additional anchoring. The loops 28 should be of sufficiently large size so as to be able to alternatively or supplementally receive a sizable weighty log (of up to about 8" diameter) through the loops to constitute a form of deadman anchorage, more particularly where insufficient or no stakes are readily available. Fold-up straps 34 extend from opposite ends of some of the medial bracing elements 20 or adjacent portions of the membrane thereat. When a pair of fold-up straps 34 are connected to each other above cover assembly 10, membrane 14 will be folded up along opposite sides 36 to form a trough or pocket to minimize spillage of soil supported by membrane or panel 14**.

When it becomes desirable to install one or more adjacent cover assemblies over an elongated trench, the adjacent ends of bracing strap elements 20, via preferably attached D-rings 21 (FIG. 4) provided on one end, are interconnected to one another. After the dirt is at least partially emplaced over the adjacently placed fabric membranes 14, the fold-up strap members can be similarly interconnected via their D-rings 35 to provide sufficient length to span adjacently disposed covering membranes. Additionally, straps 34 are preferably provided with approximately two inch loops 38 preferably at the same end as D-rings 35. These loops facilitate optional anchoring via tent stakes driven into the soil adjacent the end of the foxhole. Alternatively, the loops 38 will provide easy access for tie ropes which may be strung around bases of nearby tree trunks.

Although ma assembly 10 is specifically described above for use as an overhead cover for a foxhole to provide personnel with protection against injury, mat assembly 10, because of its strength characteristics and versatility, has the option of being put to use as camouflage, a foot bridge, revetment, or other general purposes. Instead of being used as an overhead cover for a foxhole, mat assembly 10 may be placed and secured over and across a narrow ravine or ditch, filled with dirt or other available material to form a substantially level surface to provide a foot bridge or like path for personnel movement thereon across the ravine or ditch. Because of its strength characteristics, mat assembly 10 will support at least one soldier walking thereon across a ravine or ditch. Also, because of its ability to support and retain dirt and other material therein, including small logs, brush, shrubbery, or the like, mat assembly 10 will naturally function as camouflage to obscure battle positions and/or equipment. Further, because of its ability to contain and retain sand, dirt, cement, and other material without spillage, mat assembly 10 has the additional optional use as revetment when properly emplaced on various battlefield surfaces.

Figure 4:
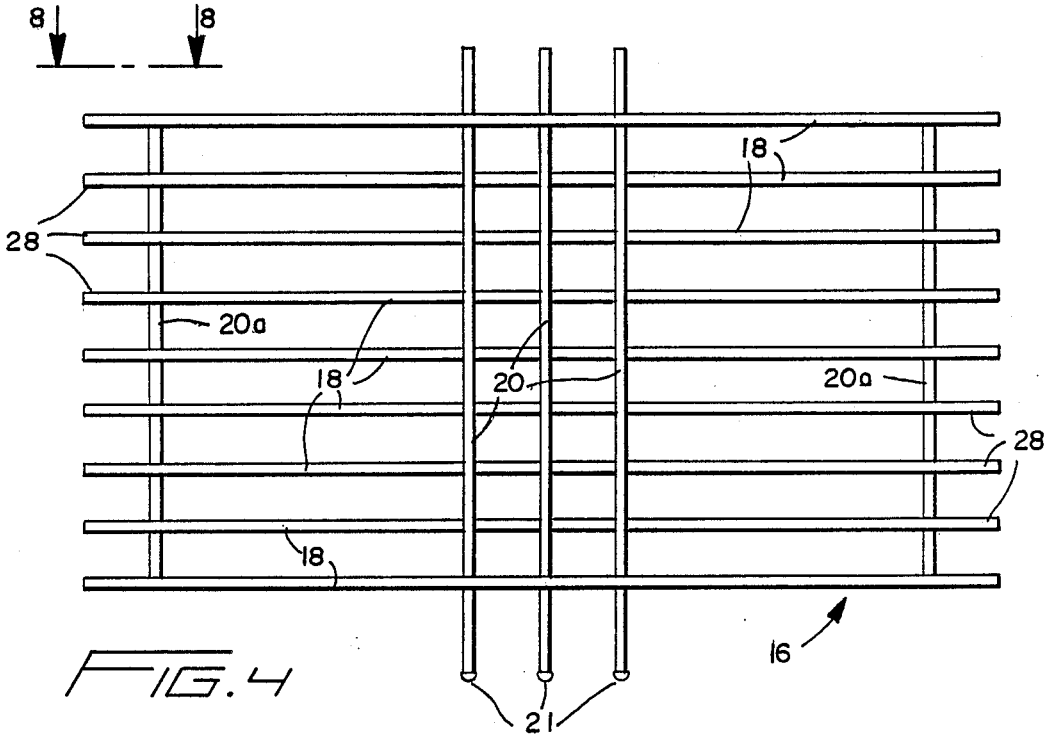
FIG. 4 represents a bottom view looking up at a support net constituting a principal load carrying or reinforcing component of the disclosed invention.
Figure 5:
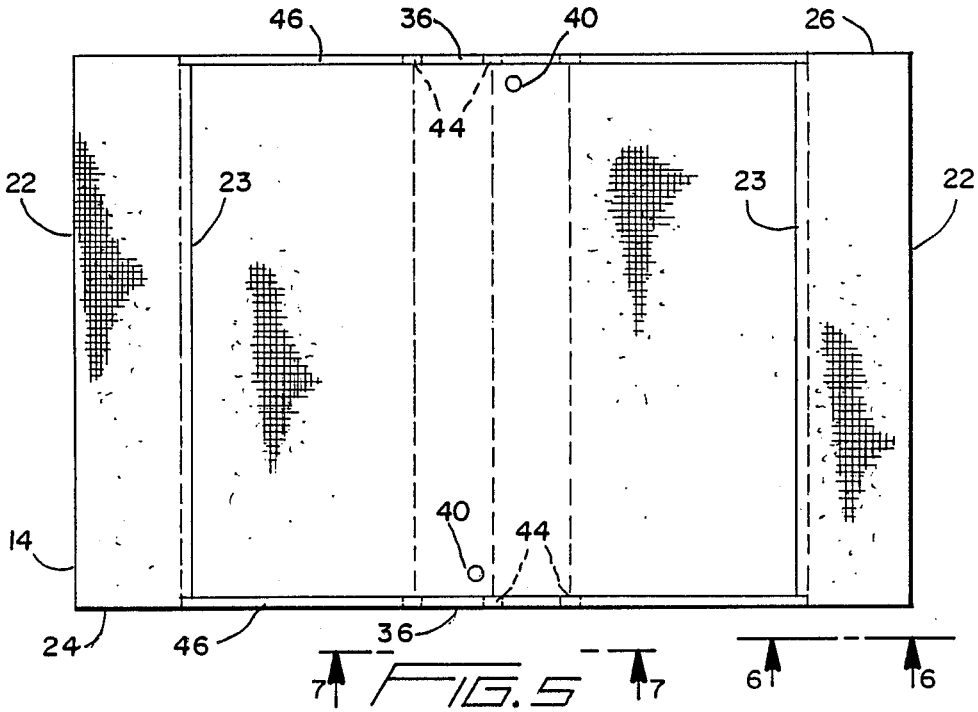
FIG. 5 represents a bottom view looking up at a soil supporting fabric constituting a second principal component of the disclosed invention.

While in the preferred embodiment of the disclosed invention support net 16 as illustrated in FIG. 4 includes nine longitudinally extending principal load carrying reinforcing straps or stringers 18, the disclosed invention is not to be restricted to the specifically shown nine such reinforcing stringers 18. Also, in the preferred embodiment of the disclosed invention, reinforcing stringers are disposed approximately six inches apart from each other, but may instead be from four to nine inches apart from each other. Relative to the bracing elements 20, the three which extend transversely of support net 16 in the general vicinity of the transverse center line, are preferably spaced nine inches apart, but may instead include additional elements and be spaced from six to nine inches apart or include a minimum of three such elements in number spaced at nine inches when the foxhole 11 or trench is limited to three feet in width. The three bracing elements 20 extending adjacent the centerline area are on the order of approximately seventy inches in length, while bracing elements 20 adjacent opposite ends of stringers 18 are on the order of approximately forty-eight inches in length. These shorter bracing elements **20*a*, which are also interconnected with each of the stringers 18 and terminate at the respective outermost stringers, are located approximately eight inches from the respective adjacent ends of said stringers 18. These latter shorter length bracing elements or straps 20*a* serve to tie together the respective end portions of longitudinal stringer elements 18, to thereby prevent their entanglement both in storage or during field installation. Each stringer 18 is on the order of approximately one hundred inches in length. The longer bracing elements 20 adjacent the centerline area are on the order of approximately sixty-eight inches in length, each extending approximately ten inches beyond the outermost stringer adjacent thereto. Transverse bracing elements 20 extending to one side of support net 16 preferably have free fused ends thereat and formed with the aforementioned two inch loops 38 on opposite ends of these bracing elements 20 and provided thereat with said D-ring elements 35 to form fold-up straps. This arrangement facilitates the aforementioned joining and securing adjacent covers and/or nets together to provide a continuous trench cover for longer trenches. Width of stringers 18 and bracer elements 20 should be on the order of from one to two inches in width to provide adequate support surface onto which fabric membrane 14 may be overlaid and also to provide ample stitching area. Stitching is preferably of a lock type stitch, whereby webbing straps forming the net's stringers and bracing elements, and the marginal reinforcement for membrane 14, may be stitched to each other using a single X surrounded by a box perimeter, preferably using a polyester thread. Fabric membrane 14** which is preferably made of butyl coated nylon fabric is on the order of about 19 oz. per square yard. The butyl coating provides protection against biological and chemical agents.

Additional accessories for use with the disclosed invention to enhance its versatilities include optional separate elongated seventy inch fold-up straps preferably provide with similar D-rings and fused ends for mating with corresponding free transverse ends of support net 16 for effecting tie-up of the sides of cover to form a trough to prevent spillage of dirt therefrom. These separate straps, besides being used to tie up edges of cover panel 14, can also be threaded through loops of support net 16 to attach around a tree base or other natural anchorage. Transverse length of these straps should terminate at preferably four inches beyond the width of fabric membrane with loop portions exposed. Fold-up straps 34 should be at least one and are preferably three in number for a three feet wide trench.

Forming the network 16 of straps separate and apart from the overlaying membrane 14 provides the advantage of ease of installation and weight reduction of components which can be divided between two soldiers for a usual two-man foxhole. Also, the use of a separate network provides the option of enabling improvised cover layer of sufficiently strong material. Another advantage of making fabric membrane component 14 and support strap network component 16 separately from each other permits the replacement of one or the other component in case either should be damaged or suffer undue wear. Also, such components can be interchanged with replacement components having different weight or types of fabric membrane panel, such as use of ballistic fabric, such as multiple layers of ballistic nylon or KEVLAR TM for cloth made of aramid fibers or the like.

An additional feature of the disclosed invention resides in the formation or provision of optional drain holes 40 in fabric membrane 14 at opposite lateral or transverse sides 36 close to or beneath the fold-up portion forming a trough or pocket so as to direct any contaminated drainage water/drippings away from the soldier sheltered therebelow.

Figure 6:
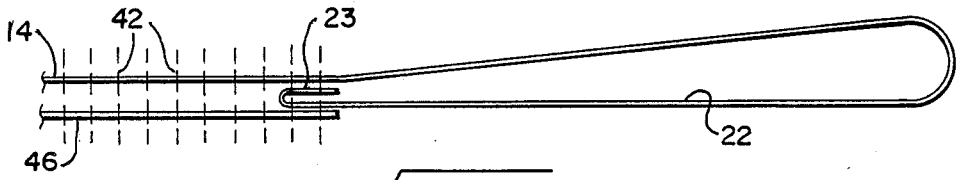
FIG. 6 represents an exploded fragmentary view taken on line 6—6 in FIG. 5 on an enlarged scale to show details of the disclosed invention.

Deadman sleeve or pocket members 22 formed at opposite ends of fabric membrane 14 as shown in detail in FIG. 6 is approximately twelve inches in width, but may be on the order of preferably eleven to fifteen inches to receive shovel size of filling soil to provide adequate cylindrical shaped deadman anchorage. Also, as may be seen in FIG. 6, sleeve member 22 is formed at its base with an inward reverse fold overlap 23 on the order of one inch in width and stitched at 42 to its upper web portion and a lower or bottom ply. As may be seen in detail in FIG. 8, the size of stake-down loops 28 at opposite ends 30, 32 of stringers 18 is four inches in width, but can be between four to twelve inches, the larger twelve inch size being adaptable to receive a large log of seven and a half inch diameter as a deadman. Loop stitching 42 should include a minimum of four inches overlap or blocking from terminal base of the loop as illustrated in FIG. 6.

Figure 7:
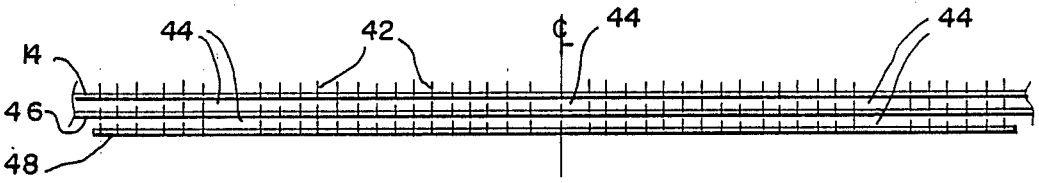
FIG. 7 represents an exploded fragmentary schematic view taken along line 7—7 in FIG. 5 on an enlarged scale to show other details of the disclosed invention.

Additionally, other types of straps with buckles, as well as Velcro type fastener devices, can be used with the disclosed invention. However, one disadvantage of using Velcro devices arises in the event that the small loops and/or eyelets become clogged with dirt and water and are subject to freezing in cold climate. The fold-up strap ends of the basic support net 16 are insertable through pre-spaced gaps 44 (FIG. 7) between stitching of one or more reinforcement margin webbing straps 46 and the fabric membrane 14, or alternatively between the first reinforcement marginal strap 46 and an optional second reinforcement strap 48 (FIG. 7). Strap 48 may be of shorter length confined to the middle lateral edge portion of the membrane 14. The end loops 28 of stringers or straps 18 are normally staked down with conventional twelve inch aluminum stakes 15 commonly used in United States Army field operation procedures.

In the event that the support net member 16 is not available for use, fabric membrane 14 with deadman sleeves 22 can be emplaced and successfully used if covering with soil is done carefully working from outside edges inward. In the absence of auxiliary strap members, soldiers can improvise by using regular rope. Use of the disclosed fabric overhead cover assembly 10 provides the advantage of eliminating potential secondary missiles otherwise produced when covers made of wood, bamboo or aluminum structure are used and sustain a direct hit.

In the stitching of fabric membrane 14, the gaps 44 are preferably about one and three fourths inches wide and may be provided as illustrated in FIG. 7 to accommodate or receive ends of bracing elements 20 or fold-up straps 34 to facilitate folding up opposite sides 36 to form a trough or pocket as described above.

Figure 7A:
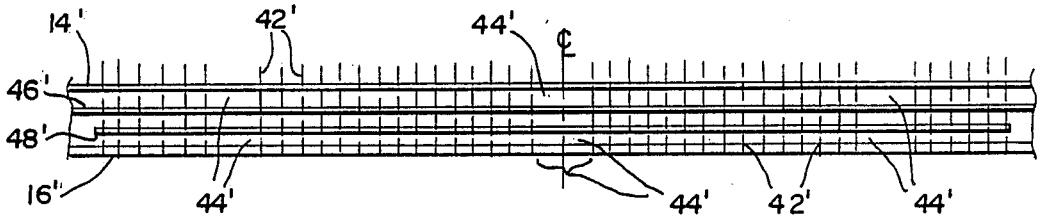
FIG. 7A is a fragmentary view similar to FIG. 7 but representative of a modified embodiment depicting a unitary reinforced mat in which the support network and fabric membrane are integrated.
Figure 8:
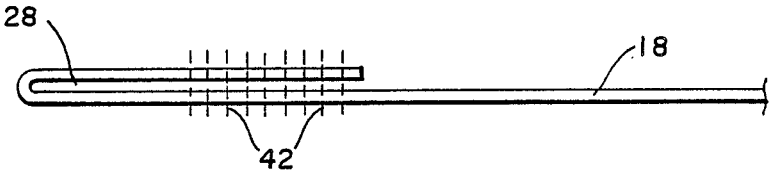
FIG. 8 represents a partially exploded view taken along line 8—8 in FIG. 4 on an enlarged scale to show details thereat.

The alternate embodiment of a unitary reinforced mat is shown in the fragmentary semi-schematic cross-sectional view of FIG. 7A. Primed reference characters are used to designate the corresponding components wherein the previously separate network and fabric or membrane components are integrated by the stitching 42'. Because of the essentially identical character and function of the respective elements and components, no further detailed description is deemed to be necessary.

It will be apparent to those skilled in the art that various changes may be made without departing from the scope of the invention; and therefore, the invention is not limited to what is shown in the drawings and described in the specification but only as indicated in the appended claims.

What is claimed is:

1. A portable mat assembly for combat soldiers suitable for battlefield emplacement preferably as an overhead cover assembly for supporting a load of loose or sandbagged soil over a foxhole battle position up to about 36 inches in width to provide occupants of the position protection against high velocity ballistic fragments and blast overpressure produced by near-miss indirect fire, but also adaptable for use as camouflage, as a foot bridge across a narrow ravine or ditch, or as revetment, or any other general utilitarian function, wherein said mat assembly comprises:

a. soil supporting means including a durable, rectangular fabric main body panel or membrane;

b. a support reinforcing net disposed beneath said fabric body membrane, substantially fully co-extensive therewith, said support net comprising a first plurality of parallel longitudinally extending principal load carrying and reinforcing straps and a second plurality of transversely disposed parallel bracing straps extending transversely of and interconnecting with said principal straps;

c. said principal straps having loops formed at opposite ends thereof for reception of stakes thereby providing means for anchoring said reinforcing net in stretched taut relation over a foxhole or trench;

d. fold-up straps means including plural pairs of separable connectable strap members at least portions of which are operatively connected with and extend laterally from opposite generally medial portions of said coextensively disposed net and body membrane where by when at least a pair of longitudinally spaced fold-up straps are connected to each other above said body membrane panel of said mat assembly, said body membrane will be folded up along opposite sides to form a trough or pocket to help retain and minimize spillage of soil supported by said mat assembly; and e. wherein said fabric membrane is provided with deadman sleeve members on opposite ends thereof whereby when said sleeve members are filled with logs or loose soil and covered with additional loose soil an anchoring effect will be provided.

2. The mat assembly as defined in claim 1, wherein said fabric membrane is formed of butyl coated nylon cloth with a 4.5 oz. base fabric.

3. The mat assembly as defined in claim 1, wherein said support net is formed of nylon webbing.

4. The mat assembly of claim 1, wherein said membrane and reinforcing strap network are integrated into a common unitary mat or cover.

5. The mat assembly as defined in claim 1, wherein said principal straps are laterally spaced apart from each other and include a total of as many as about nine of said principal straps and said bracing elements are longitudinally spaced apart from each other and include a total of as many as about five of said bracing elements.

6. The mat assembly as defined in claim 1, wherein said principal straps are laterally and substantially equally spaced apart from each other and include a total of as many as about nine of said principal straps and said bracing elements are longitudinally spaced apart from each other and include a total of as many as about five of said bracing elements, of which at least three of said bracing elements are substantially equally spaced apart and interconnected with said longitudinal principal load carrying and reinforcing straps at their central or medial intersections therewith, and at least one more of said bracing elements similarly disposed but in greater spaced apart relation near opposite end portions of said respective first plurality of said principal load carrying and reinforcing straps.

7. The mat assembly as defined in claim 1, wherein said straps are laterally spaced apart from each other and include a total of as many as eleven of said straps and said bracing straps are longitudinally spaced apart from each other and include a total of as many as five of said bracing straps.

8. The mat assembly as defined in claim 1, wherein said second plurality of bracing straps have end portions formed with loops to facilitate supplemental anchoring by stakes or tie ropes inserted through said loops.

9. The mat assembly of claim 1, wherein said main body panel or membrane includes drain holes adjacent opposite lateral sides thereof close to or beneath the trough or pocket formed by said fold-up straps.

10. A portable mat assembly for combat soldiers suitable for battlefield emplacement preferably as an overhead cover assembly for supporting a load of loose or sandbagged soil over a foxhole battle position up to about 36 inches in width to provide occupants of the position protection against high velocity ballistic fragments and blast overpressure produced by near-miss indirect fire, but also adaptable for use as camouflage, as a foot bridge across a narrow ravine or ditch, or as revetment, or any other general utilization function, wherein said mat assembly comprises:

a. soil supporting means including a durable, rectangular fabric main body panel or membrane;

b. a support reinforcing net disposed beneath said fabric body membrane, substantially fully co-extensive therewith, said support net comprising a first plurality of parallel longitudinally extending principal load carrying and reinforcing straps and a second plurality of transversely disposed parallel bracing straps extending transversely of and interconnecting with said principal straps;

c. said principal straps having loops formed at opposite ends thereof for reception of stakes thereby providing means for anchoring said reinforcing net in stretched taut relation over a foxhole or trench;

d. fold-up straps means including plural pairs of separable connectable strap members at least portions of which are operatively connected with and extend laterally from opposite generally medial portions of said coextensively disposed net and body membrane whereby when at least a pair of longitudinally spaced fold-up straps are connected to each other above said body membrane panel of said mat assembly, said body membrane will be folded up along opposite sides to form a trough or pocket to help retain and minimize spillage of soil supported by said mat assembly; and e. wherein said main body panel or membrane is provided with opposed marginal spaced apertures spaced so as to receive and portions of said fold-up strap means.

* * * * *